US006456181B2

(12) United States Patent
Nakamura

(10) Patent No.: US 6,456,181 B2
(45) Date of Patent: Sep. 24, 2002

(54) IGNITION COIL

(75) Inventor: Kazuhiro Nakamura, Osaka (JP)

(73) Assignee: Diamond Electric Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/735,923

(22) Filed: Dec. 14, 2000

(30) Foreign Application Priority Data

Dec. 14, 1999 (JP) ..... 11-354014

(51) Int. Cl.[7] ..... H01F 27/02
(52) U.S. Cl. ..... 336/96; 336/90; 336/92
(58) Field of Search ..... 336/90, 96, 92; 123/634, 635

(56) References Cited

U.S. PATENT DOCUMENTS 5,706,792 A * 1/1998 Boyer et al. ..... 123/634
6,005,464 A * 12/1999 Sakamaki et al. ..... 336/96
6,308,696 B1 * 10/2001 Kondo et al. ..... 123/634

* cited by examiner

*Primary Examiner*—Anh Mai
(74) *Attorney, Agent, or Firm*—McGinn & Gibb, PLLC

(57) ABSTRACT

An ignition coil which directly distributes the high voltage to an ignition plug, includes a case, a central iron core, a secondary coil in which a secondary copper wire is coaxially wound around the central iron core, being housed in the case, a primary coil in which a primary copper wire is wound around the outside of the case, and a sheath iron core arranged outside the primary coil.

20 Claims, 5 Drawing Sheets

IGNITION COIL

BACKGROUND OF THE INVENTION

The present invention relates to the structure of an ignition coil to supply the high voltage to an ignition plug.

For the ignition coil used in the recent internal combustion engine for the automobile, there is a conflicting requirement which is the downsizing and the increasing of the output for corresponding to a lean-burn engine considering about the global atmosphere.

Among them, the ignition coil to directly supply the high voltage to the ignition plug, has advantages that the space above the engine head can be reduced because the a portion or an almost portion of the ignition coil is accommodated in a plug hole of the engine head, the generation of the noise at the time of the ignition which has a bad influence on the electrical equipments, is small because the high voltage is directly supplied to the ignition plug and a wire to transmit the high voltage to the ignition plug such as a high tension cable to directly supply the high voltage to the ignition plug, is not necessary, and the transmission loss of the ignition energy to the ignition plug is small, and therefore, it is used for many engines.

A longitudinal sectional view showing the conventional ignition coil to directly supply the high voltage to the ignition plug is shown in FIG. 4. Conventionally, in an upper accommodation portion 11*b* of a case 11 of the ignition coil to directly supply the high voltage to the ignition plug, a primary voltage input portion 12, or depending on the case, an igniter 13 to turn on-off the primary current is accommodated, and inside the case 11, a central iron core 18 on which magnets 21 to generate the magnetic flux in the direction reverse to the magnetic flux generated in a primary coil 15 in order to suppress the saturation of the magnetic flux of the iron core, are mounted, on its both ends, is accommodated, and a secondary coil 17 in which a secondary copper wire is wound around a secondary bobbin 16, a primary coil 15 in which a primary copper wire is wound around a primary bobbin 14, and a sheath iron core 19 which is formed into the cylindrical-shape, and has a cutout portion on a portion of its circular periphery, are arranged in their order, coaxially with the central iron core 18, and a secondary high voltage terminal 22 is provided on the bottom portion of the case 11, and the secondary high voltage terminal 22 is electrically connected to the secondary coil and a spring 23 in a high voltage tower portion 11*a* provided in the case 11, and from the opening portion of the upper portion of the case 11, epoxy resin is filled in the case, hardened, and the case is sealed in the insulation. Further, in the high voltage tower portion 11*a*, a protector 25 is provided so that the high voltage does not leak to a metallic portion such as a plug hole, not shown, and at the time of operation of the ignition coil, the primary current is inputted from the primary voltage input portion 12, and it flows to the primary coil 15, and the magnetic energy generated in the primary coil 15 is transmitted through the central iron core 18 and the sheath iron core 19, and the high voltage corresponding to the winding ratio of the primary coil 15 and the secondary coil 17 is generated in the secondary coil 17. The generated high voltage passes through the secondary high voltage terminal 22 from the secondary coil, and through the spring 23, it is sent to the ignition plug, not shown, connected to the spring 23.

However, in the conventional technology, as shown in FIG. 5, because the secondary coil 17 coaxially arranged with the central iron core 18 in the case 11, is housed in the primary coil 15 coaxially arranged in the same manner, and the insulation of the high voltage output side of the secondary coil 17 is made by filling and hardening the insulation material such as epoxy resins, the epoxy resin is peeled from each of members by the aging thermal stress, and specifically when the primary bobbin 14 is peeled in the vicinity of the high voltage portion of the secondary coil 17, the high voltage generated in the secondary coil 17 leaks in the space formed by the peeling, and the high voltage is short-circuited to the low voltage portion such as the primary coil 15 in such a manner that the high voltage creeps along the surface of the member, and it causes the disadvantage which results in the dielectric breakdown.

Further, as the ignition coil to generate the high voltage energy, there are methods in which the winding number of the primary coil 15 and the secondary coil 17 is kept as it is, and the diameter of the wound coil is increased, and the electric resistance of these coils is reduced, or the outer shape of the coil is increased in such a manner that the sectional area of the iron core is increased and the efficiency of the magnetic circuit is increased, however, for the cylindrical type ignition coil which is a type to be housed in the plug hole whose diameter is generally called to be about 20 to 35 mm, and in which the restriction of the dimensions is severe, it is difficult that the primary coil 15, secondary coil 17, central iron core 18, sheath iron core 19, and igniter 13 are housed in the case 11, and the above method is adopted.

Further, even when the ignition coil is not the type which is housed in the plug hole, there is a requirement of the size and weight reduction for the ignition coil, from points of attachment property, oscillation property, and consumption energy.

SUMMARY OF THE INVENTION

Accordingly, the object of the present invention is to solve the above problems and to provide a long life and small sized ignition coil.

In order to attain the above object, the structure of the ignition coil to directly supply the high voltage to the ignition plug, is changed from the conventional one. The ignition coil of the present invention is an ignition coil which is characterized in that: the central iron core, and the secondary coil in which the secondary copper wire is coaxially wound around the central iron core, are housed in the case, and the primary coil in which the primary copper wire is wound around the outside of the case, coaxially with the central iron core in the same manner, and the sheath iron core is arranged outside these central iron core, secondary coil, case and primary coil.

Further, the ignition coil of the present invention may also be an ignition coil which is characterized in that the heat resistive insulation material is wound to protect the primary coil, and the heat resistive insulation material is wound, and further, it may be characterized in that the heat resistive insulation material is mounted on the outside of sheath iron core of the ignition coil, and as the heat resistive insulation material, the insulation tape, heat contraction tube, fluoric-rubber, or silicon may be used.

When the above solving means is used, the disadvantage in which the secondary output high voltage flows and leaks in the primary coil 15 in the vicinity of the peeled portion, in the epoxy resin peeling from the primary bobbin 14 and the secondary bobbin 16 inside the case 11 by the aging deterioration of the conventional ignition coil, is not generated because the secondary coil 17 and the primary coil 15 are partitioned from each other, when the secondary coil 17 is housed in the case 11, and the primary winding is wound around the outside of the case.

Further, when the primary bobbin portion 14*a* is provided in the case 11, the wall thickness portion of the conventional primary bobbin 14 is abolished, and in its space portion, the diameter of the winding can be increased, or the sectional area of the sheath iron core 19 can be increased, and the secondary output energy can be increased, and when the diameter of the winding or the sectional area of the sheath iron core 19 is the same as the conventional one, the outer shape of the ignition coil can be reduced to the smaller one by the amount of the wall thickness of the primary bobbin 14.

DETAILED DESCRIPTION OF THE PREFERRED EMBODIMENTS

An embodiment according to the present invention will be described referring to FIG. 1 to FIG. 3.

Figure 1:
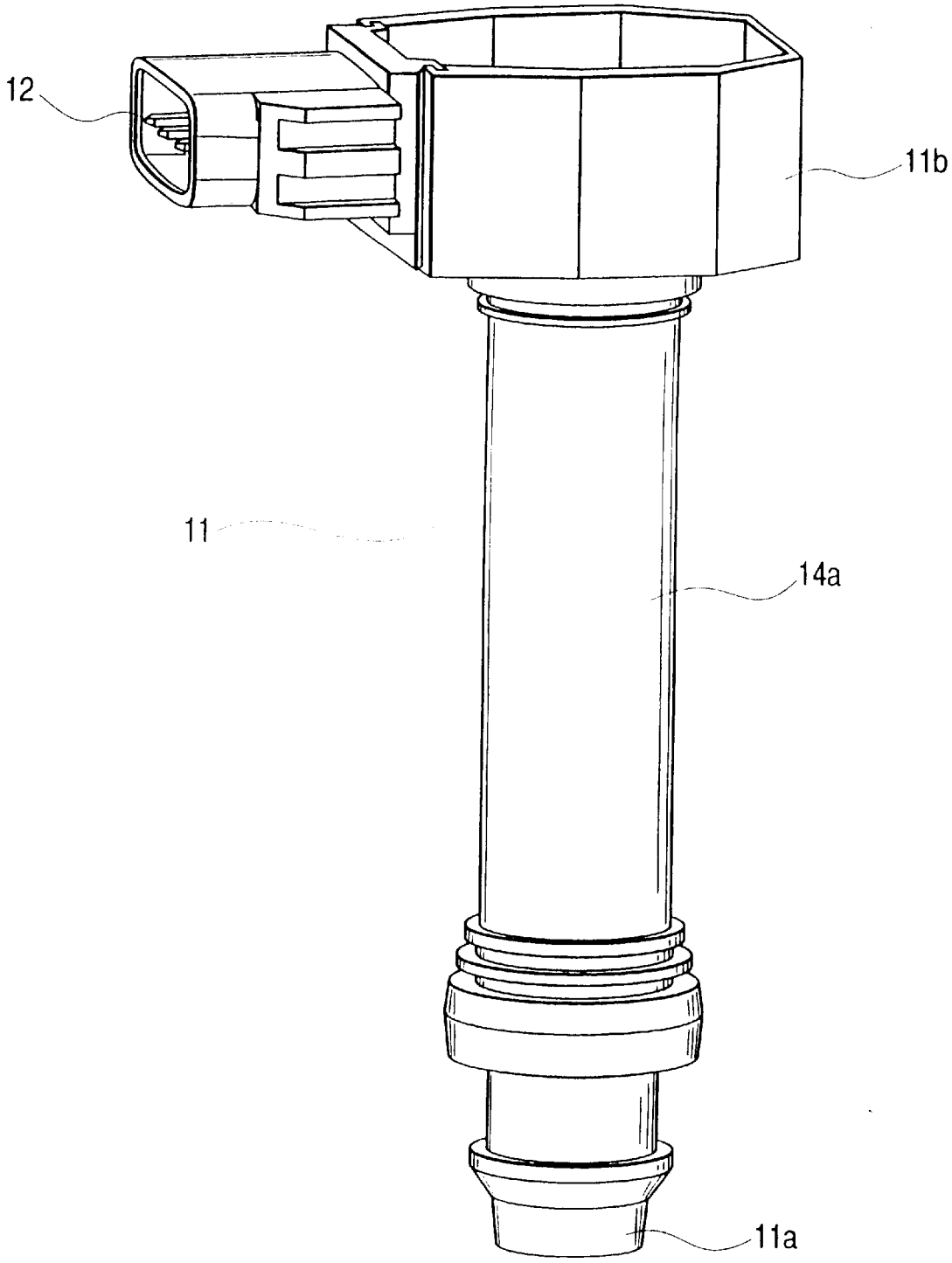
FIG. 1 is a longitudinal sectional view of the ignition coil to directly supply the high voltage to the ignition plug, showing the embodiment to which the technology of the present invention is applied.
Figure 2:
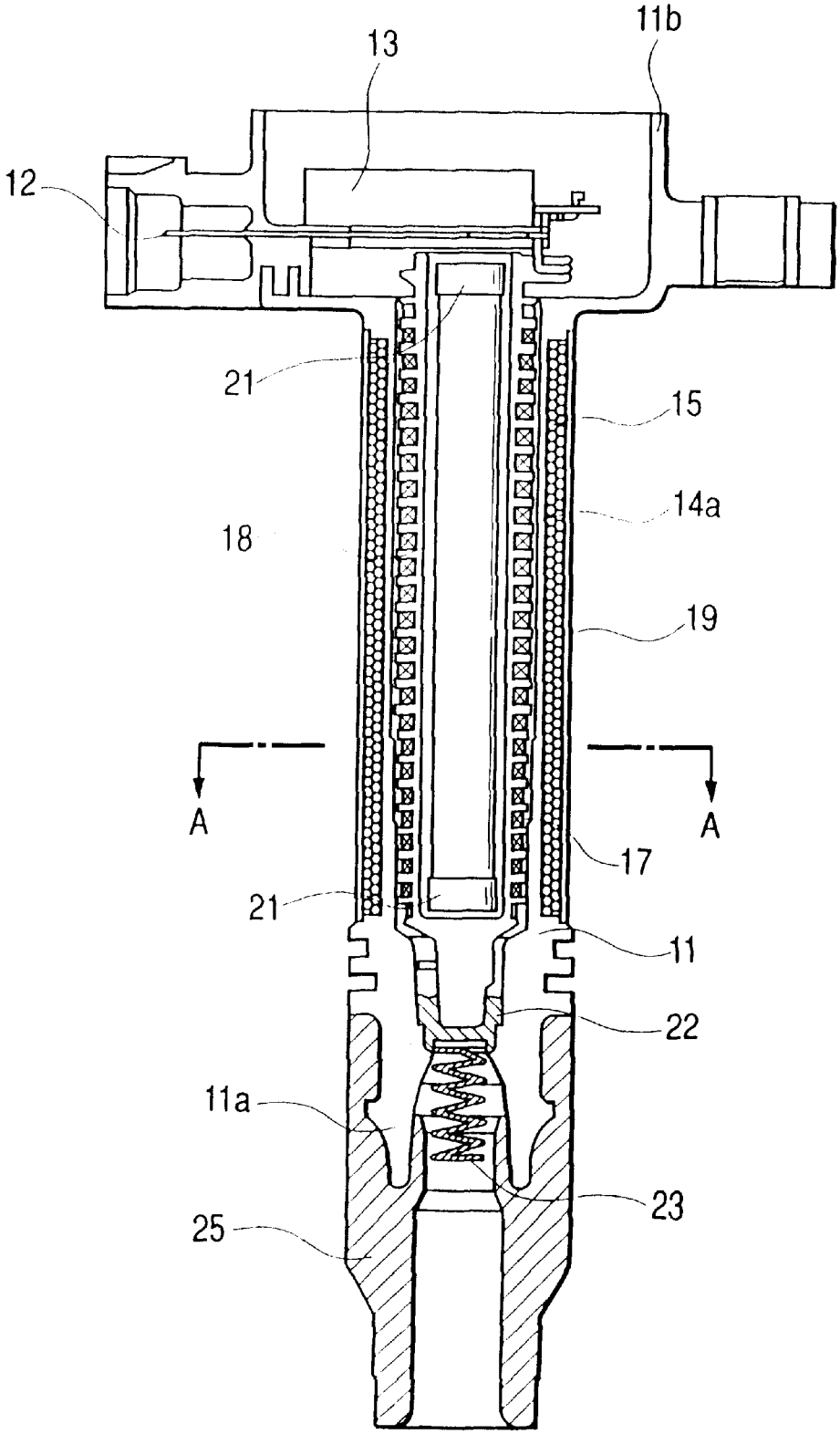
FIG. 2 is a sectional view cut out on line A—A of the ignition coil to directly supply the high voltage to the ignition plug, showing the embodiment to which the technology of the present invention is applied.

FIG. 1 is a longitudinal sectional view of the ignition coil to directly supply the high voltage to the ignition plug, showing an embodiment to which the technology of the present invention is applied, and FIG. 2 is a sectional view cut out on line A—A of the ignition coil to directly supply the high voltage to the ignition plug, showing an embodiment to which the technology of the present invention is applied. Further, FIG. 3 is a perspective view showing the case 11 of the ignition coil to directly supply the high voltage to the ignition plug, showing an embodiment to which the technology of the present invention is applied.

Figure 3:
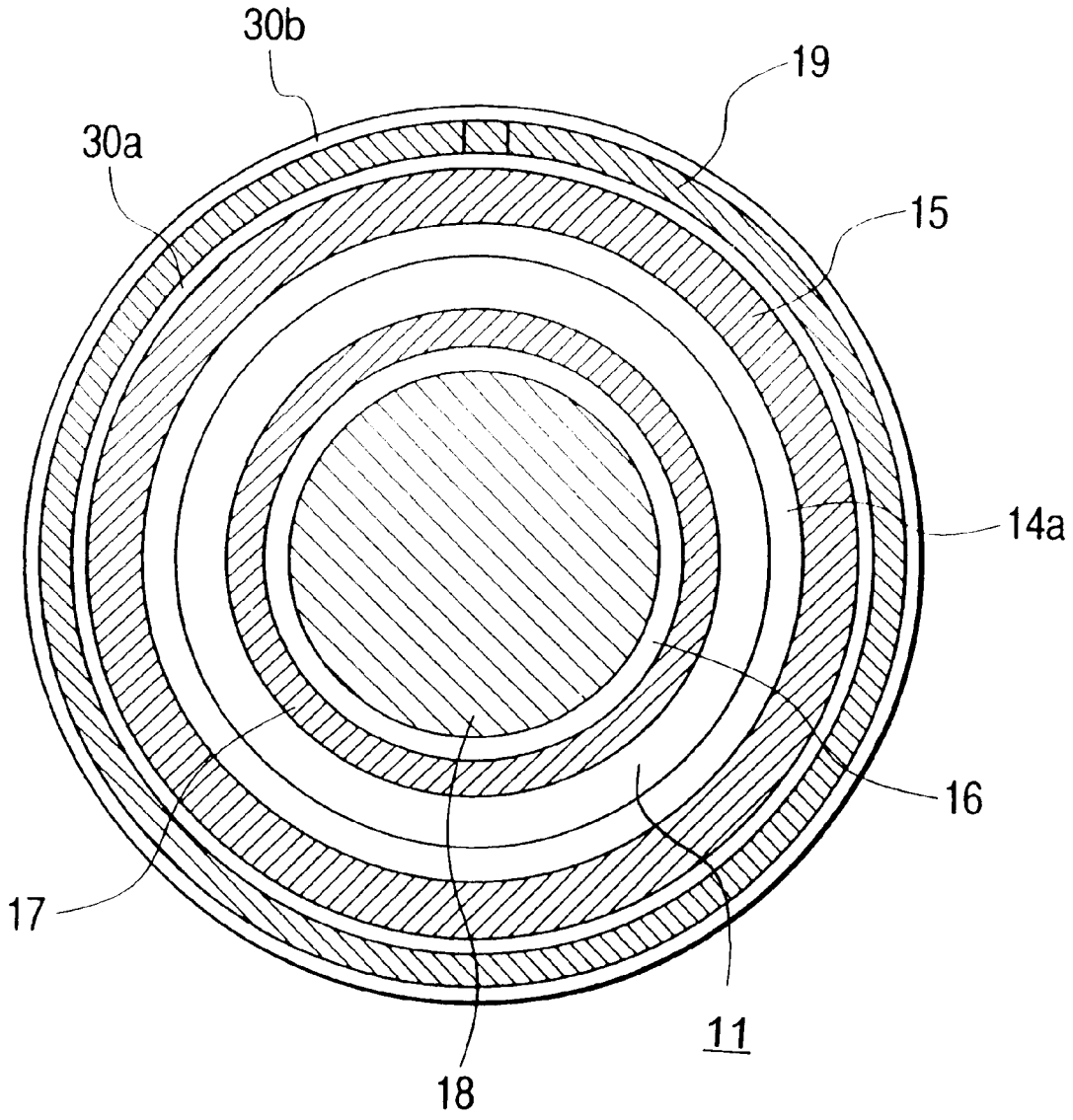
FIG. 3 is a perspective view showing the case 11 of the ignition coil to directly supply the high voltage to the ignition plug, showing the embodiment to which the technology of the present invention is applied.
Figure 4:
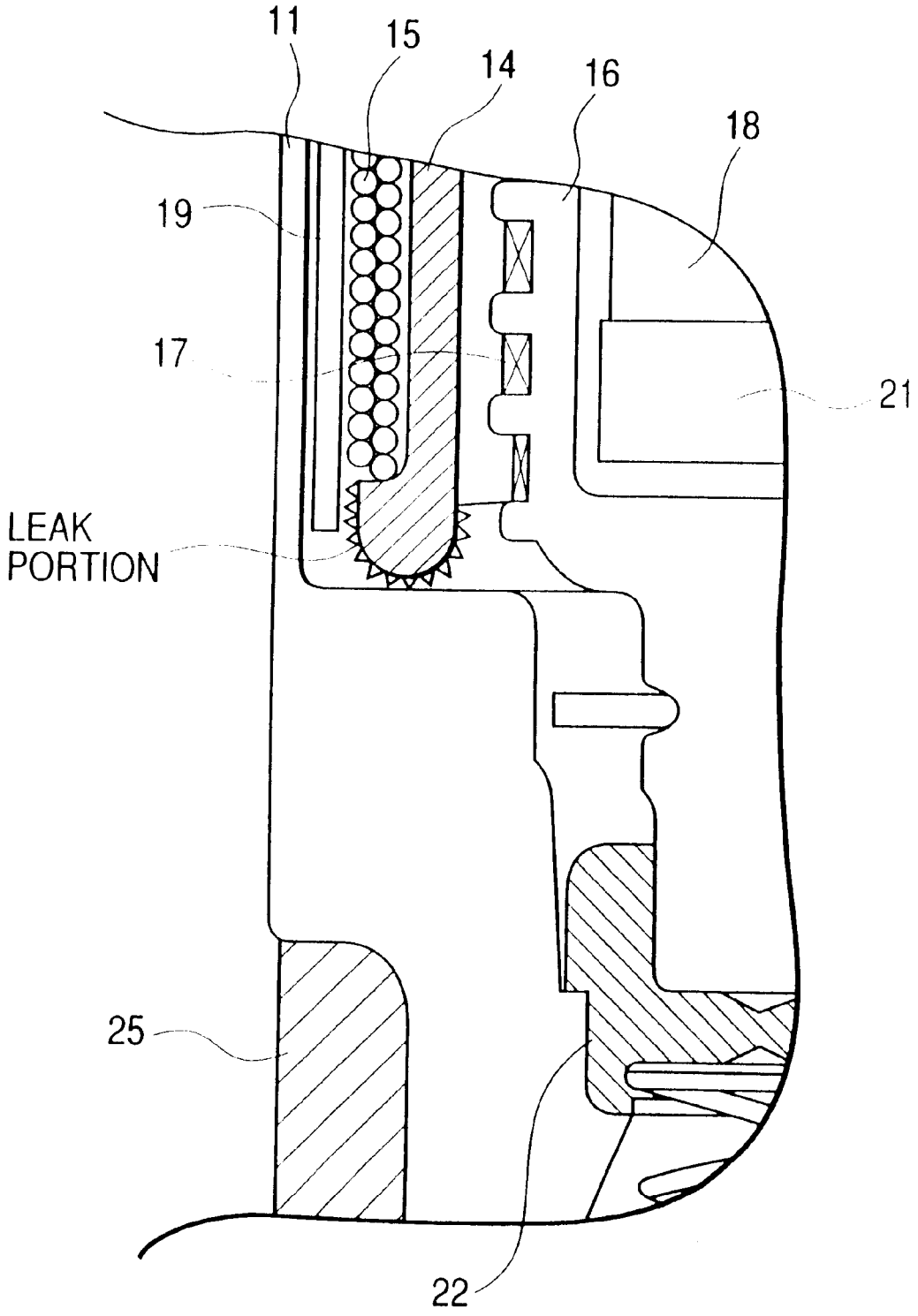
FIG. 4 is a longitudinal sectional view showing the conventional ignition coil to directly supply the high voltage to the ignition plug.
Figure 5:
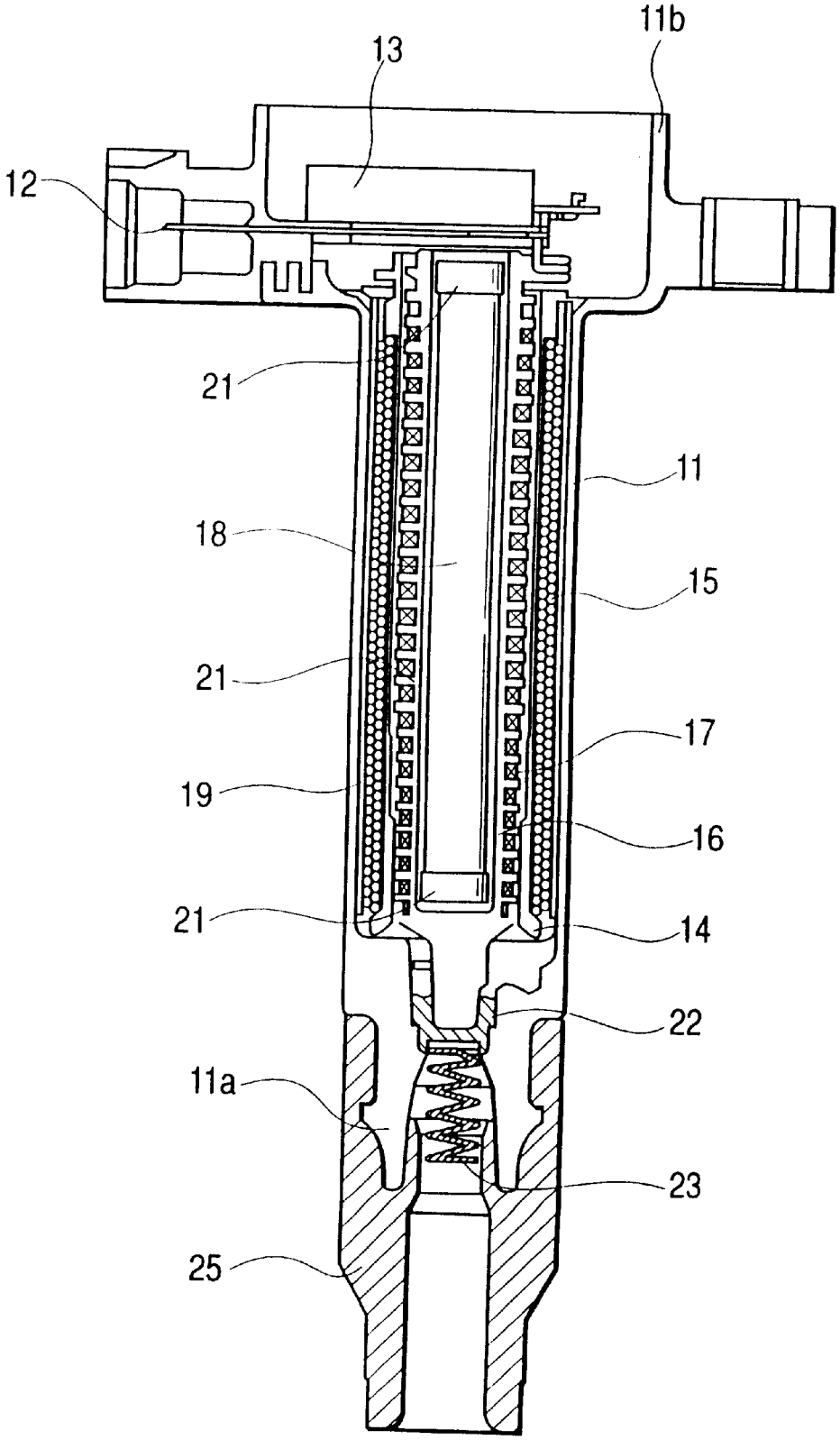
FIG. 5 is an enlarged longitudinal sectional view showing the generation process of the leak failure in the vicinity of the high voltage of the secondary coil of the conventional ignition coil to directly supply the high voltage to the ignition plug.

According to FIG. 1 to FIG. 3, in the embodiment of the present invention, a primary voltage input portion 12 is attached in an upper accommodation portion 11*b* of the case 11, or depending on the case, an igniter 13 to turn on-off the primary current is accommodated therein, and in the inside of the case 11, the central iron core and a secondary coil 17 in which a secondary copper wire is wound around the secondary bobbin 16 coaxially with the central iron core, are accommodated, and the central iron core 18 is equipped with magnets 21 by which the magnetic flux in the reverse direction to the magnetic flux generated in the primary coil 15, to suppress the saturation of the iron core, is generated, on its both ends. A secondary high voltage terminal 22 to supply the high voltage to the ignition plug, not shown, is provided on the bottom portion in the case 11, and the secondary high voltage terminal 22 is electrically connected to the secondary coil 17. The epoxy resin is filled from the opening portion of the upper portion of the case 11, and hardened, and the case 11 is sealed in the insulation. Further, as shown in FIG. 3, the primary winding is wound around the primary bobbin portion 14*a* of the case 11, and the primary coil 15 is formed, and the primary coil 15 is electrically connected to the primary voltage input terminal, not shown, of the primary voltage input portion 12. The surface of the primary coil 15 is protected by the heat resistive insulation material 30*a*, and as this heat resistive insulation material 30*a*, at least one of the heat resistive insulation tape, silicon, fluoric-rubber, or heat resistive insulation heat contraction tube, is used. The sheath iron core 19 is assembled. on its outside. The sheath iron core 19 is formed into the cylindrical-shape, and the cutout portion provided on a portion of its circular periphery, and the spring force is provided against the force to spread the cutout portion. By this spring force, the sheath iron core 19 is equipped and fixed onto the surface of the winding of the primary coil 15 protected by the heat resistive insulation material 30*a*. Further, the heat resistive insulation material 30*b* is assembled on the outside of the sheath iron core 19. As the heat resistive insulation material 30*a*, at least one of the heat contraction tube, fluoric-rubber, or silicon, is used and the sheath iron core 19 is protected in the heat resistance, and withstand-voltage. Further, in the same manner as the conventional ignition coil, the secondary high voltage terminal 22 on the bottom portion of the case 11 is electrically connected to the secondary coil 17 and the spring 23 in the high voltage tower portion 11*a* provided in the case 11, and in the high voltage tower portion 11*a*, the protector 25 is provided so that the high voltage does not leak to the metallic portion such as the plug hole, not shown, and when the ignition coil is operated, the primary current is inputted from the primary voltage input portion 12, and it flows to the primary coil 15, and the magnetic energy generated in the primary coil 15 is transmitted through the central iron core 18 and the sheath iron core 19, and the high voltage corresponding to the ratio of the number of windings of the primary coil 15 and the secondary coil 17 is generated in the secondary coil 17. The generated high voltage passes through the secondary high voltage terminal 22 from the secondary coil, and is sent to the ignition plug, not shown, connected to the spring 23 through the spring 23.

Further, the case 11 used for the ignition coil of the present invention, is not only integrally formed, but may also be the structure in which the upper accommodation portion 11*b* accommodating the igniter 13, and the primary bobbin portion 14*a* around which the primary coil are wound, are separately formed, and integrated by assembling.

When the ignition coil of the present invention is used, because the secondary coil 17 is isolated in the inside of the case 11, and separated from members such as the primary coil 15, which become electrically low voltage, even when the epoxy resins are peeled from each member by the thermal stress by aging, and the secondary coil 17 is peeled in the vicinity of the secondary high voltage portion, the ignition coil in which the high voltage does not leak into the space, and the disadvantage in which the high voltage is short-circuited to the primary coil 15 in such a manner that it creeps along the surface of the member, and it results in the dielectric breakdown, is not generated, can be provided.

Further, when the primary bobbin portion 14*a* is provided in the case 11, the wall thickness portion of the conventional primary bobbin 14 is abolished, and in the space, the diameter of the winding can be increased, or the sectional area of the sheath iron core 19 can be increased, or when the diameter of the winding or the sectional area of the sheath iron core 19 is the same as the conventional one, the outer shape of the ignition coil can be reduced by the amount of the wall thickness of the primary bobbin 14.

What is claimed is:

1. An ignition coil which directly distributes the high voltage to an ignition plug, comprising:

a case;

a central iron core;

a secondary coil in which a secondary copper wire is coaxially wound around said central iron core, being housed in said case;

a primary coil in which a primary copper wire is wound around the outside of said case; and a sheath iron core arranged outside said primary coil.

2. The ignition coil according to claim 1, wherein a heat resistive insulation material is wound around the surface of said primary coil.

3. The ignition coil according to claim 2, wherein the heat resistive insulation material on the surface of said primary coil is selected from the group of an insulation tape, heat contraction tube, fluorine rubber, and silicon.

4. The ignition coil according to claim 1, wherein a heat resistive insulation material is attached on the outside of said sheath iron core.

5. The ignition coil according to claim 4, wherein the heat resistive insulation material on the outside of said sheath iron core is selected from the group of an insulation tape, heat contraction tube, fluorine rubber, and silicon.

6. The ignition coil according to claim 1, wherein said secondary coil and said primary coil are partitioned from each other by a case wall.

7. An ignition coil which directly distributes a high voltage to an ignition plug, comprising:

a case;

a central iron core within said case; and a primary coil in which a primary wire is wound around the outside of said case.

8. The ignition coil according to claim 7, further comprising:

a secondary coil in which a secondary wire is coaxially wound around said central iron core.

9. The ignition coil according to claim 8, wherein said secondary coil is housed in said case.

10. The ignition coil according to claim 7, further comprising:

a sheath iron core arranged outside said case.

11. The ignition coil according to claim 7, further comprising:

a sheath iron core arranged outside said primary coil.

12. The ignition coil according to claim 7, wherein said primary coil and said case are integrated.

13. The ignition coil according to claim 7, wherein a heat resistive insulation material is wound around the surface of said primary coil.

14. The ignition coil according to claim 10, wherein a heat resistive insulation material is attached on the outside of said sheath iron core.

15. The ignition coil according to claim 11, wherein a heat resistive insulation material is attached on the outside of said sheath iron core.

16. The ignition coil according to claim 7, further comprising:

a secondary coil wound inside said case.

17. The ignition coil according to claim 8, wherein said secondary coil and said primary coil are partitioned from each other by a case wall.

18. An ignition coil which directly distributes the high voltage to an ignition plug, comprising:

a case;

a central iron core;

a first coil in which a first wire is coaxially wound around said central iron core, being housed in said case;

a second coil in which a second wire is wound around the outside of said case; and a sheath iron core arranged outside said second coil.

19. The ignition coil according to claim 18, wherein said first coil and said second coil are partitioned from each other by a case wall.

20. The ignition coil according to claim 18, wherein a heat resistive insulation material is wound around the surface of said second coil.

* * * * *